US011613450B2

(12) United States Patent
Jang et al.

(10) Patent No.: US 11,613,450 B2
(45) Date of Patent: Mar. 28, 2023

(54) LIFTER

(71) Applicant: SAMSUNG ELECTRONICS CO., LTD., Suwon-si (KR)

(72) Inventors: Dongryol Jang, Suwon-si (KR); Kangsuk Lee, Suwon-si (KR); Jeongdoo Jang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/041,571

(22) PCT Filed: Feb. 11, 2019

(86) PCT No.: PCT/KR2019/001605
§ 371 (c)(1),
(2) Date: Sep. 25, 2020

(87) PCT Pub. No.: WO2019/198924
PCT Pub. Date: Oct. 17, 2019

(65) Prior Publication Data

US 2021/0017004 A1 Jan. 21, 2021

(30) Foreign Application Priority Data

Apr. 10, 2018 (KR) ..... 10-2018-0041454

(51) Int. Cl.
*B66D 1/30* (2006.01)
*B66D 1/12* (2006.01)
*B66F 7/02* (2006.01)

(52) U.S. Cl.
CPC ..... *B66D 1/30* (2013.01); *B66D 1/12* (2013.01); *B66D 2700/0183* (2013.01); *B66F 7/02* (2013.01); *B66F 2700/09* (2013.01)

(58) Field of Classification Search
CPC ... B66D 1/12; B66D 1/30; B66D 1/36; B66D 3/04; B66D 2700/0183; B66F 2700/09
See application file for complete search history.

(56) References Cited

U.S. PATENT DOCUMENTS 1,782,358 A * 11/1930 Lang ..... B66D 1/36 242/157.1
4,611,787 A * 9/1986 May ..... B66D 1/7415 254/371

(Continued)

FOREIGN PATENT DOCUMENTS

CA 2844269 A1 * 8/2014 ..... E21B 19/24
CN 103588131 B 4/2017

(Continued)

OTHER PUBLICATIONS

Extended European Search Report dated Mar. 25, 2021, in corresponding European Patent Application No. 19785532.3.

(Continued)

*Primary Examiner* — Sang K Kim
*Assistant Examiner* — Nathaniel L Adams
(74) *Attorney, Agent, or Firm* — Staas & Halsey LLP

(57) ABSTRACT

A lifter is disclosed. The disclosed lifter comprises: a frame; a motor part coupled to the frame; a drum rotatably coupled to the motor part and including a plurality of winding parts formed at regular intervals along the rotary shaft direction; and a plurality of wires coupled to be wound on the plurality of winding parts, respectively. Ends of the plurality of wires at one side thereof may be connected to the plurality of winding parts, respectively, and other ends of the plurality of wires may be detachably fixed to a ceiling.

15 Claims, 9 Drawing Sheets

(56) References Cited

U.S. PATENT DOCUMENTS

| | | | | | |
|---|---|---|---|---|---|
| 4,953,829 | A * | 9/1990 | Knaack | B66D 1/34 | 254/DIG. 14 |
| 5,361,565 | A * | 11/1994 | Bayer | B66C 13/26 | 254/273 |
| 5,564,637 | A * | 10/1996 | Berthold | B65H 54/2872 | 242/484.1 |
| 6,254,171 | B1 * | 7/2001 | Young, Sr. | B60P 3/34 | 296/165 |
| 6,435,447 | B1 * | 8/2002 | Coats | B65H 54/2848 | 242/483.3 |
| 6,507,962 | B2 * | 1/2003 | Thurston | A47C 17/84 | 5/10.1 |
| 7,325,785 | B2 * | 2/2008 | Krengel | A47F 5/0892 | 254/338 |
| 7,527,242 | B2 * | 5/2009 | Shaha | E04H 6/42 | 254/338 |
| 7,610,636 | B2 * | 11/2009 | Holmes | B60P 3/36 | 5/118 |
| 7,963,505 | B2 * | 6/2011 | Taylor | B66D 1/26 | 248/329 |
| 8,544,823 | B2 * | 10/2013 | Imberi | B66D 1/12 | 254/338 |
| 8,720,811 | B2 * | 5/2014 | Zink | B65H 75/4402 | 242/397.2 |
| 9,150,392 | B2 * | 10/2015 | Skyba | B66D 1/06 | |
| 9,527,707 | B1 * | 12/2016 | Fehringer | B66D 3/04 | |
| 9,908,754 | B2 * | 3/2018 | Hall | B66D 1/12 | |
| 10,336,590 | B2 * | 7/2019 | Hall | B66D 1/38 | |
| 10,549,958 | B2 * | 2/2020 | Yudate | B66C 13/18 | |
| 11,124,394 | B2 * | 9/2021 | Ou | B66D 1/38 | |
| 2002/0178497 | A1 * | 12/2002 | Thurston | A47C 17/84 | 5/10.1 |
| 2006/0120846 | A1 * | 6/2006 | Krengel | A47B 5/00 | 414/592 |
| 2008/0129086 | A1 * | 6/2008 | Holmes | B60P 1/02 | 5/9.1 |
| 2010/0314594 | A1 * | 12/2010 | Seow | B66D 1/7447 | 254/333 |
| 2011/0127477 | A1 * | 6/2011 | Kokolis | B66D 1/26 | 254/338 |
| 2014/0291030 | A1 * | 10/2014 | Urquhart | E21B 19/24 | 175/203 |

FOREIGN PATENT DOCUMENTS

| | | | | | |
|---|---|---|---|---|---|
| CN | 111606229 | A | * | 9/2020 | |
| ES | 2362276 | T3 | * | 6/2011 | B66D 1/34 |
| FR | 2 689 415 | A1 | | 10/1993 | |
| GB | 1 388 658 | A | | 3/1975 | |
| JP | 5-47795 | U | | 6/1993 | |
| JP | 7-315800 | A | | 12/1995 | |
| JP | 2808068 | B2 | | 10/1998 | |
| JP | 2914628 | B2 | | 7/1999 | |
| JP | 3068873 | U | | 5/2000 | |
| JP | 2007-46887 | A | | 2/2007 | |
| JP | 4162247 | B2 | | 10/2008 | |
| JP | 2016-16940 | A | | 2/2016 | |
| KR | 1994-0011339 | A | | 6/1994 | |
| KR | 94-20983 | | | 10/1994 | |
| KR | 2001-0087778 | | | 9/2001 | |
| KR | 10-0615383 | B | | 8/2006 | |
| KR | 10-2009-0041232 | A | | 4/2009 | |
| KR | 10-2014-0027789 | A | | 3/2014 | |
| KR | 10-1382208 | B1 | | 4/2014 | |
| KR | 10-1640982 | B1 | | 7/2016 | |
| RU | 1789500 | A1 | * | 1/1993 | |
| RU | 2668880 | C1 | * | 10/2018 | |
| WO | WO 2006/007522 | A2 | | 1/2006 | |
| WO | WO-2011092999 | A1 | * | 8/2011 | B66D 1/38 |
| WO | WO-2017020122 | A1 | * | 2/2017 | E21B 19/24 |

OTHER PUBLICATIONS

International Search Report, PCT/ISA/210, dated May 17, 2019, in corresponding International Patent Application No. PCT/KR2019/001605.

Written Opinion of the International Searching Report, PCT/ISA/237, dated May 17, 2019, in corresponding International Patent Application No. PCT/KR2019/001605.

Office Action dated Jul. 1, 2022, issued in Korean Application No. 10-2018-0041454.

Korean Notice of Allowance dated Dec. 7, 2022, in Korean Patent Application No. 10-2018-0041454 (7 pages, plus 1 page English translation).

Office Action dated Feb. 2, 2023, in European Patent Application No. 19785532.3.

* cited by examiner

LIFTER

CROSS-REFERENCE TO RELATED APPLICATIONS

This application is a U.S. National Stage Application which claims the benefit under 35 U.S.C. § 371 of International Patent Application No. PCT/KR2019/001605 filed on Feb. 11, 2019, which claims foreign priority benefit under 35 U.S.C. § 119 of Korean Patent Application 10-2018-0041454 filed on Apr. 10, 2018, in the Korean Intellectual Property Office, the contents of both of which are incorporated herein by reference.

TECHNICAL FIELD

The disclosure relates to a lifter with improved versatility and convenience of use.

BACKGROUND ART

The lifter is an apparatus for lifting a product necessary for works or lifting a product to be installed at a certain height to work at the corresponding height.

In recent years, buildings, shopping malls, apartments, and houses have various heights of ceilings with non-flat floors depending on interior design, and in some cases, a lot of structures are installed on the floor.

Accordingly, in order to install various products such as a ceiling air conditioner on the ceiling, a lifter usable in various usage environments is needed.

DISCLOSURE

Technical Problem

In the related art, an elevator-type lifter which is installed on the floor and lifts a product disposed on the lifter up to the ceiling has been used. However, for the elevator-type lifter, at least two workers needed to manually lift up a product to be installed onto the ceiling, and accordingly, extra labor, time, and cost were consumed. In addition, because the elevator-type lifter needed to be fix onto the floor, it was necessary to ensure levelness of the floor before the works, and there was a limit of height in lifting the product up.

Technical Solution

An object of the disclosure is to provide a lifter easily usable by a worker without effects of various heights of ceilings and flatness of a floor.

In accordance with an aspect of the disclosure, there is provided a lifter including a frame, a motor part coupled to the frame, a drum rotatably coupled to the motor part and including a plurality of winding parts formed at regular intervals along a rotary shaft direction, and a plurality of wires connected to be wound around the plurality of winding parts, respectively, in which one ends of the plurality of wires are connected to the plurality of winding parts, respectively, and other ends of the plurality of wires are detachably fixed to a ceiling.

The drum may include a core, and a plurality of ribs formed vertically on an outer peripheral surface of the core and disposed at regular intervals along the rotary shaft direction to partition the plurality of winding parts.

The drum may be disposed at a center of the frame, the frame may include a plurality of vertical pulleys disposed radially from the center of the frame, and the plurality of vertical pulleys may be disposed between the one ends and the other ends of the plurality of wires respectively to change a direction of the plurality of wires to a direction perpendicular to the ceiling.

The plurality of winding parts may include first to fourth winding parts, and the plurality of wires may include first to fourth wires wound around the first to fourth winding parts, respectively.

The plurality of ribs may include first to fifth ribs, and each of the first to fourth winding parts may be formed between two adjacent ribs among the first to fifth ribs.

The plurality of vertical pulleys may include first to fourth vertical pulleys disposed radially from the center of the frame, and the first to fourth wires may be wound around the first to fourth vertical pulleys, respectively.

The first to fourth vertical pulleys may be disposed horizontally on the same plane.

The lifter may further include a plurality of horizontal pulleys disposed between the one ends of the plurality of wires and the plurality of vertical pulleys, respectively.

The plurality of horizontal pulleys may include first to fourth horizontal pulleys facing the outer peripheral surface of the drum, and the first to fourth horizontal pulleys may be disposed between the one ends of the plurality of wires and the first to fourth vertical pulleys, respectively, and the first to fourth wires may be wound around the first to fourth horizontal pulleys, respectively.

The first and second horizontal pulleys may be positioned at one side of the drum, and the third and fourth horizontal pulleys may be positioned at a side opposite to the first and second horizontal pulleys with respect to the drum.

Each rotary shaft of the first to fourth vertical pulleys may be disposed to be parallel with the ceiling, and each rotary shaft of the first to fourth horizontal pulleys may be disposed to be perpendicular to the rotation shaft of the first to fourth vertical pulleys.

The lifter may further include a plurality of pressurization parts configured to be inserted to the plurality of winding parts, respectively, and pressurize the plurality of wires wound around the plurality of winding parts towards the core, respectively.

Each of the plurality of pressurization parts may include a pressurization member coming into contact with each of the plurality of wires, and a fixing member coupled to the pressurization members to enable the pressurization member to rotate.

An elastic member may be disposed at one end of the fixing ember, and the elastic member may be connected to a lower extending part extending to be parallel with a shaft direction of the drum at a certain interval from the drum.

The frame may include a square main body part facing the ceiling, an extending part formed at each corner of the main body part, and a loading part disposed on an upper surface of the main body part, the plurality of vertical pulleys may be disposed on each extending part, and the motor part and the drum may be disposed on a lower portion of the center of the main body part.

DETAILED DESCRIPTION OF EXEMPLARY EMBODIMENTS

In order to fully understand configurations and effects of the disclosure, preferred embodiments of the disclosure will be described with reference to the accompanying drawings. However, the disclosure is not limited to the embodiments below and may be implemented in various forms and variously changed. The description regarding the embodiments is provided to complete the disclosure and let those skilled in the art completely know the scope of the disclosure. Elements in the accompanying drawings are shown enlarged from their actual sizes for convenience of description and a proportion of each element may be magnified or reduced.

It should be understood that, when it is described that a certain element is "on" or "in contact with" another element, the certain element may be directly on or connected to another element, but still another element may exist between those. In contrast, it should be understood that, when it is described that a certain element is "directly on" or "directly in contact with" another element, still another element may not exist. The same interpretation may apply to expressions describing the relationship between elements, for example, "between" or "directly between".

The expressions "first," "second" and the like may be used for describing various elements, but the elements may not be limited by the expressions. The expressions may be used only to distinguish one element from another. For example, a first element may be referred to as a second element and the second element may also be similarly referred to as the first element, while not departing from the scope of a right of the disclosure.

Unless otherwise defined specifically, a singular expression may encompass a plural expression. It is to be understood that the terms such as "comprise" or "consist of" are to designate a presence of characteristic, number, step, operation, element, part, or a combination thereof, and may be interpreted as that one or more of other characteristics, numbers, steps, operations, elements, parts or a combination thereof may be added.

The terms used in the embodiments of the disclosure may be interpreted as meanings known to those skilled in the art, unless otherwise defined.

Figure 1:
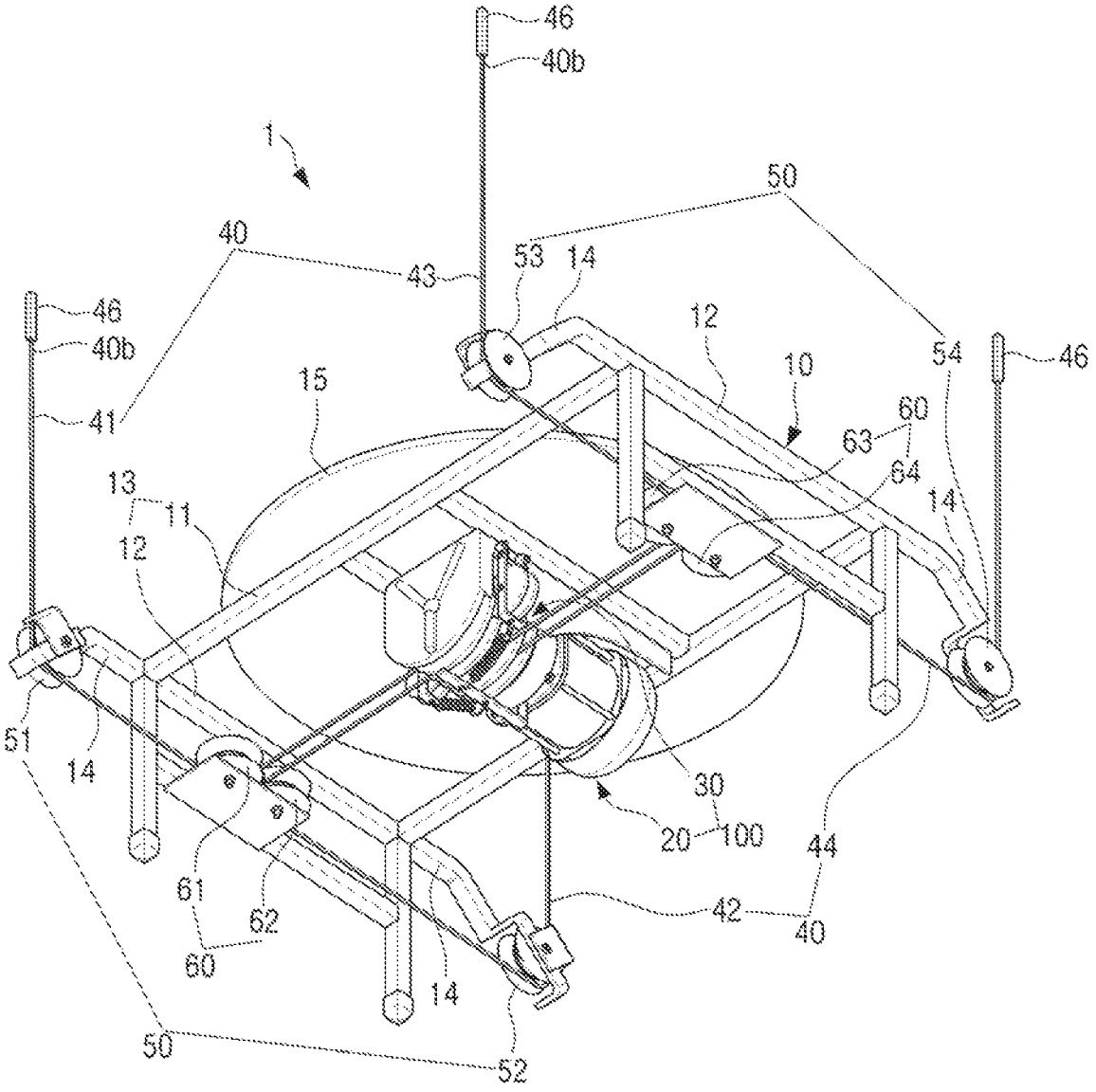
FIG. 1 is a bottom perspective view illustrating a lifter according to an embodiment.
Figure 2:
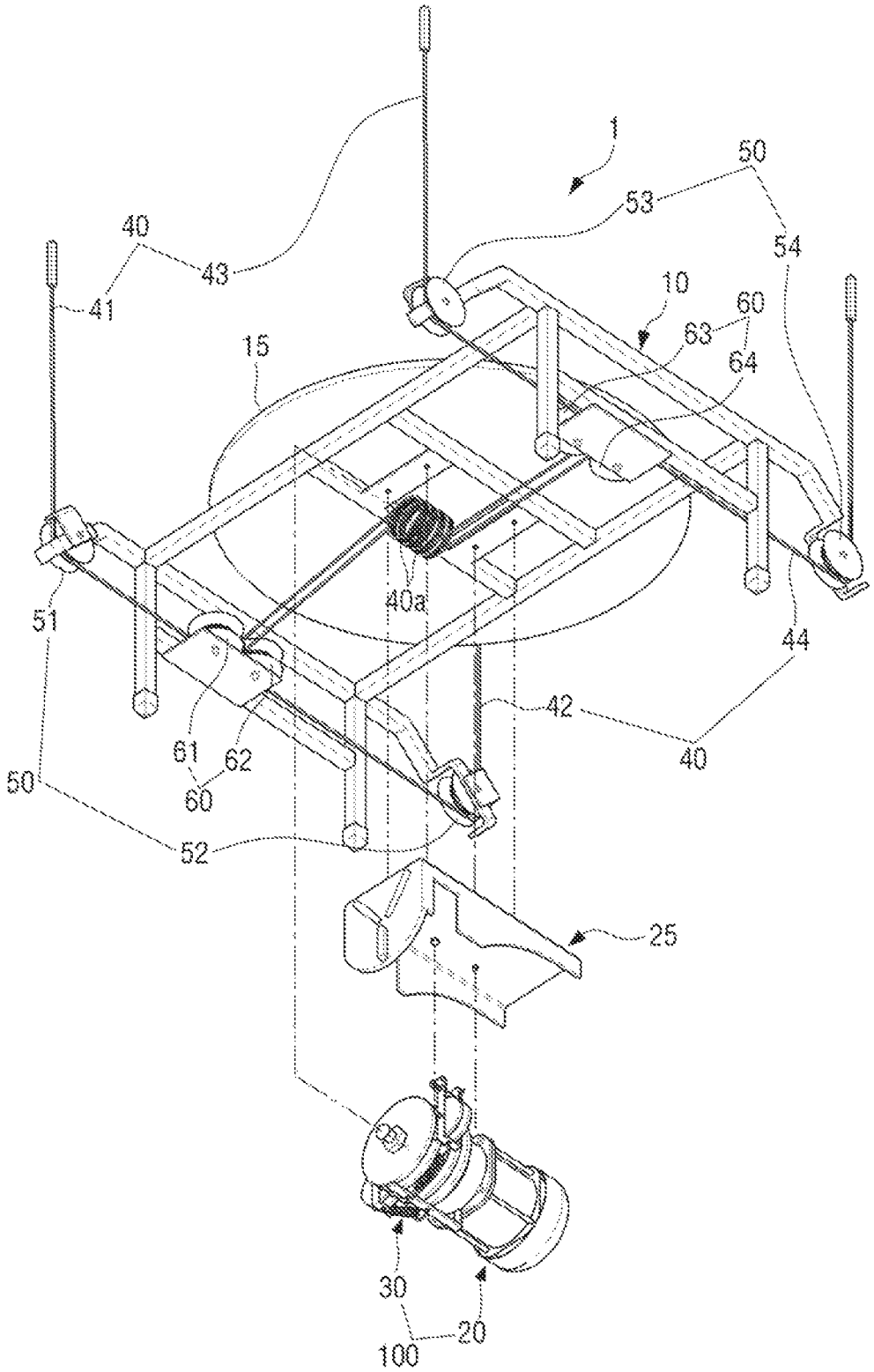
FIG. 2 is an exploded perspective view illustrating that a frame and a driving part illustrated in FIG. 1 are separated.

FIG. 1 is a bottom perspective view illustrating a lifter 1 according to an embodiment and FIG. 2 is an exploded perspective view illustrating that a frame 10 and a driving part 100 illustrated in FIG. 1 are separated.

Hereinafter, a structure of the lifter 1 will be described with reference to FIGS. 1 and 2.

Referring to FIG. 1, the lifter 1 may include the frame 10, the driving part 100 including a motor part 20 and a drum 30, a plurality of wires 40, a plurality of vertical pulleys 50, and a plurality of horizontal pulleys 60.

The frame 10 may form the entire structure of the lifter 1 and the frame 10 may be formed substantially in a square shape so that a product to be installed on a ceiling is placed.

Specifically, the frame 10 may include a main body part 13, an extending part 14, and a loading part 15.

The main body part 13 may have a square shape facing a ceiling C (see FIG. 8) and the square shape may be formed of a plurality of rods including horizontal rods 11 and vertical rods 12.

The main body part 13 is preferably formed to be parallel with the ceiling (or floor) without tilting to one side. Accordingly, even when a product P is directly disposed on the main body part 13, the product P may be stably positioned on the main body part 13.

In addition, if necessary, the main body part 13 may be formed in a polygonal or circular shape, in addition to the square.

The extending part 14 may be formed at each corner of the main body part 13 and may extend from the corner of the main body part 13. Further, the plurality of vertical pulleys 50 which will be described below may be disposed on the extending parts 14, respectively.

For the balance of the lifter 1, the extending parts 14 are preferably formed to be symmetrical in a horizontal direction with respect to the center of the main body part 13. Accordingly, the lifter 1 may move up and down while maintaining a certain balance without tilting to one side, even when the lifter moves up and down via one vertical pulley 50 disposed on each extending part 14 while the product P is disposed on the lifter 1.

The extending part 14 may be integrally formed with the main body part 13 and may be coupled to a corner of the main body part 13 as a separate member, if necessary.

The loading part 15 may be coupled onto the main body part 13 and disposed on an upper surface 13*a* (see FIG. 6) of the main body part.

The product P to be installed may be loaded on the loading part 15 and the product P may be lifted while being loaded on the loading part 15.

The loading part 15 may be formed of a flat plate facing the ceiling C. Accordingly, the product P disposed on the loading part 15 may not tilt to one side and may be stably positioned on the loading part 15.

The driving part 100 may drive to adjust lengths of the plurality of wires 40 connected to the ceiling C and may include the motor part 20 and the drum 30.

The driving part 100 may be disposed at a lower portion of the center of the main body part 13. Accordingly, the driving part 100 may be positioned in the vicinity of the center of gravity of the lifter 1 to maintain the entire balance of the lifter 1.

Specifically, the driving part 100 may be connected to the frame 10 via a case 25 covering an upper portion and a side portion of the driving part 100.

The case 25 may cover a side of the driving part 100 to prevent external foreign materials and the like from being introduced to the driving part 100. However, the case 25 is able to be deformed in various shapes in addition to the structure illustrated in FIGS. 1 and 2, and it is enough as long as the foreign materials are prevented from being introduced to the driving part 100.

The specific structure of the driving part 100 will be described below with reference to FIGS. 3 and 4.

The plurality of wires 40 may connect the lifter 1 to the ceiling C and may lift up the lifter 1 to the ceiling C by adjusting lengths thereof while keeping balance of the lifter 1.

One ends 40*a* of the plurality of wires 40 may be connected to the drum 30 and other ends 40*b* thereof may be detachably fixed to the ceiling C.

A separate connection member 46 may be connected to each of the other ends 40*b* of the plurality of wires 40 and the connection member 46 may detachably fix each of the plurality of wires 40 to the ceiling C.

The number of wires 40 may be more than one. For example, referring to FIGS. 1 and 2, the plurality of wires 40 may include first to fourth wires 41, 42, 43, and 44.

The first to fourth wires 41, 42, 43, and 44 may be radially diffused from the driving part 100 with respect to the frame 10 of the lifter 1 to be connected to the ceiling C. Accordingly, the lifter 1 may keep a certain balance without tilting to one side by the first to fourth wires 41, 42, 43, and 44.

For example, if the frame 10 has a square shape, the first to fourth wires 41, 42, 43, and 44 may be connected to the ceiling C via each corner of the frame 10. In addition, if the frame 10 has a circular shape, the first to fourth wires 41, 42, 43, and 44 may be disposed on an outer periphery of the circle at interval of 90 degrees and connected to the ceiling C.

The plurality of wires 40 may be formed of a metal material and may be formed of particularly stainless steel by considering durability, strength, and weight.

The connection member 46 connected to the other end 40*b* of the wire 40 may be a typical connection member such as a computer bolt or clamp and may be fixed to the ceiling C by various fixing methods such as screw fixing or bolt fixing, as necessary.

In addition, the plurality of vertical pulleys 50 and the plurality of horizontal pulleys 60 may be disposed between the one ends 40*a* and the other ends 40*b* of the plurality of wires 40, respectively.

Each of the plurality of vertical pulleys 50 may be a device around which one wire 40 is wound and which rotates the wire 40. A rotary shaft of the plurality of vertical pulleys 50 may be disposed to be parallel with the ceiling C, and accordingly, the plurality of vertical pulleys 50 may guide the wire 40 connected to the driving part 100 in a vertical direction towards the ceiling C.

Therefore, the plurality of vertical pulleys 50 may change the direction of the plurality of wires 40 smoothly to the vertical direction towards the ceiling C and may prevent direct friction of the plurality of wires 40 and the frame 10 through the rotation of the plurality of vertical pulleys 50.

In addition, along with the rotation of the plurality of vertical pulleys 50, the adjustment of the height and vertical movement of the lifter 1 may be smoothly performed.

The plurality of horizontal pulleys 60 may be disposed between the one ends 40*a* of the plurality of wires 40 and the plurality of vertical pulleys 50, respectively. By doing so, the plurality of horizontal pulleys 60 may change the direction of the wire 40 wound around the plurality of horizontal pulleys 60 to a direction towards the plurality of vertical pulleys 50.

The plurality of horizontal pulleys 60 may be the same pulleys as the plurality of vertical pulleys 50 described above. However, while the rotary shaft of the plurality of vertical pulleys 50 is parallel with the ceiling C, the plurality of horizontal pulleys 60 may be disposed so that the rotary shaft of the plurality of horizontal pulleys 60 is perpendicular to the rotary shaft of the plurality of vertical pulleys 50. In addition, if necessary, the plurality of vertical pulleys 50 and the plurality of horizontal pulleys 60 may be different in terms of size and radius.

Therefore, while the plurality of vertical pulleys 50 may change the direction of the plurality of wires 40 to the vertical direction towards the ceiling C, the plurality of horizontal pulleys 60 may change the direction of the plurality of wires 40 to the horizontal direction on the same plane.

In addition, when the plurality of vertical pulleys 50 are disposed radially from the center of the frame 10, the plurality of horizontal pulleys 60 may smoothly guide the plurality of wires 40 connected to the driving part 100 disposed at the center of the frame 10 to the plurality of vertical pulleys 50 which are radially disposed.

Further, the plurality of horizontal pulleys 60 are disposed between the driving part 100 and the plurality of vertical pulleys 50, respectively, thus the lifter 1 may stably move while maintaining a certain balance during a process in which the lifter 1 moves by adjusting the lengths of the plurality of wires 40.

The specific structures and positions of the plurality of vertical pulleys 50 and the plurality of horizontal pulleys 60 described above will be described below with reference to FIGS. 5 and 6.

Figure 3:
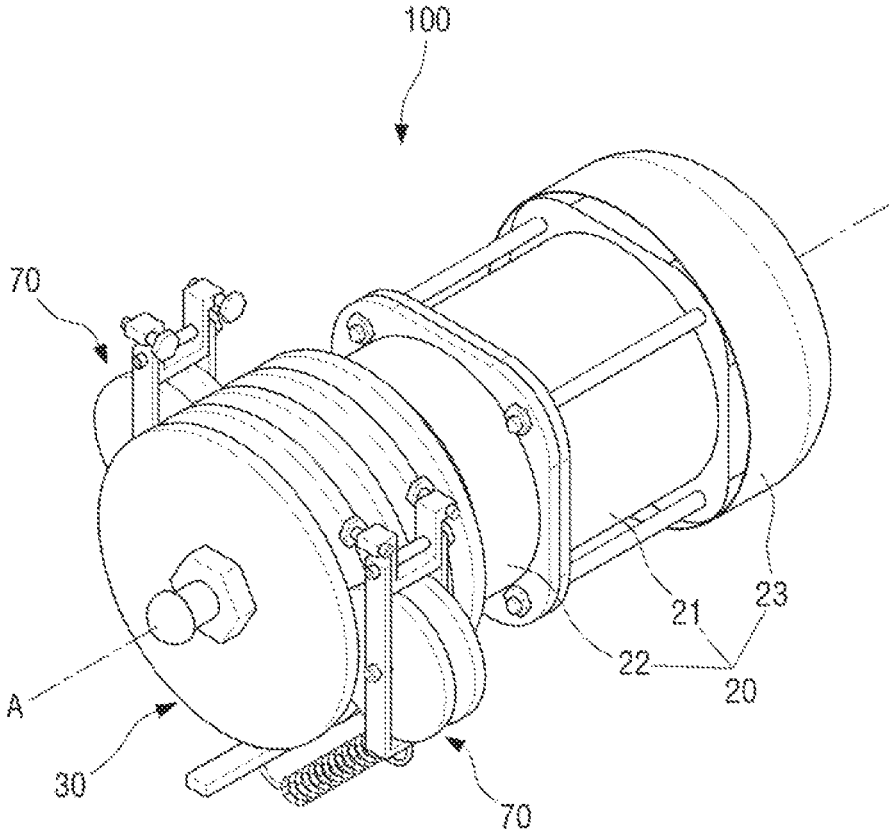
FIG. 3 is a perspective view of the driving part.
Figure 4:
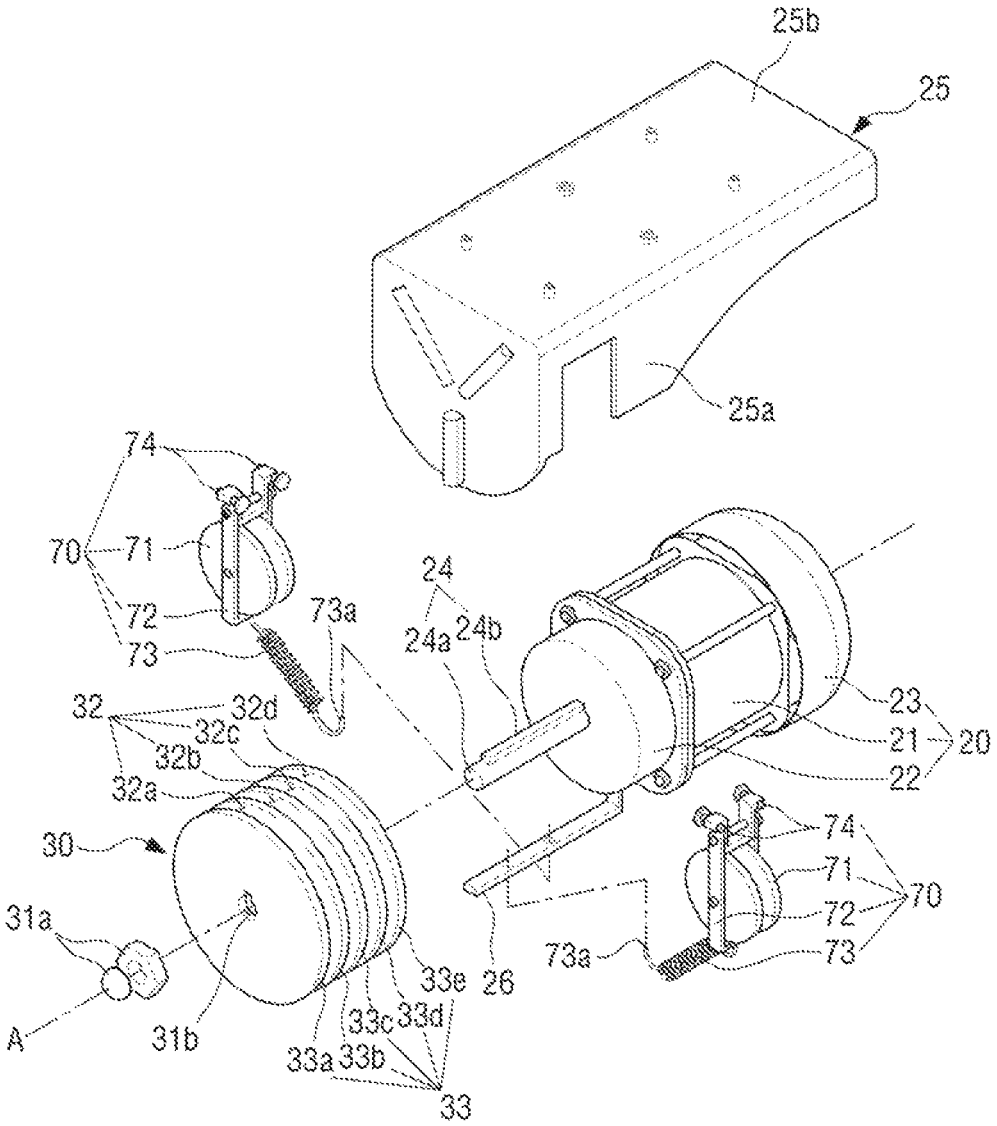
FIG. 4 is an exploded perspective view illustrating that the driving part and the case are separated.

FIG. 3 is a perspective view of the driving part 100 and FIG. 4 is an exploded perspective view illustrating that the driving part 100 and the case 25 are separated.

Hereinafter, the specific structure of the case 25 and the driving part 100 including the motor part 20 and the drum 30 will be described with reference to FIGS. 3 and 4.

The drum 30 may be rotatably coupled to the motor part 20 and the first to fourth wires 41, 42, 43, and 44 may be wound around the drum 30. The motor part 20 may be connected to the frame 10 by being coupled to the case 25 coupled to the frame 10.

Specifically, the motor part 20 may be coupled to the case 25 and may include a motor 21, a decelerator 22, and a fan 23.

The motor 21 may send a rotary power to the drum 30 coupled to a motor rotary shaft 24 to wind or rewind the plurality of wires 40 wound around the drum 30. The motor 21 may be connected to a controller (not illustrated) and a rotation direction and a rotation rate of the motor 21 may be adjusted as a user manipulates the controller.

It is enough for the motor 21 as long as the motor 21 is able to rotate the drum 30, and the motor is an element well known for those skilled in the art of the disclosure and therefore will not be specifically described herein.

The decelerator 22 may be disposed between the motor 21 and the drum 30 to be connected to the motor 21 and the drum 30. The decelerator 22 may convert or adjust the rotation of the motor 21 at a high RPM into rotation at an RPM necessary for the rotation driving of the drum 30.

The fan 23 may be disposed at a side of the motor 21 and may radiate heat generated from the motor 21 through forced convection.

In addition, the motor part 20 may include the motor rotary shaft 24 formed along a direction of a rotary shaft A at one side of the motor part 20.

The motor rotary shaft 24 may connect the motor 21 and the drum 30 and may send the rotary power generated from the motor 21 to the drum 30.

The motor rotary shaft 24 may include a rotary rod 24*a* and a protrusion part 24*b* protruding from an outer peripheral surface of the rotary rod 24*a* along the direction of the rotary shaft A.

When the motor rotary shaft 24 is inserted into a motor rotary shaft insertion opening 31*b* of a core 31 and rotates, the protrusion part 24*b* may prevent idling of the core 31 with respect to the motor rotary shaft 24 and it is possible to stably and efficiently send the rotary power generated from the motor 21 to the drum 30 and the core 31.

A connection member 31*a* may be coupled to one end of the motor rotary shaft 24, thereby stably fixing the drum 30 inserted to the motor rotary shaft 24.

The drum 30 may be rotatably coupled to the motor part 20 and may include the core 31 (see FIG. 7), a plurality of winding parts 32 and a plurality of ribs 33 formed along the direction of the rotary shaft 24 at regular intervals.

The core 31 may form a central axis of the drum 30 and the plurality of wires 40 wound around the drum 3 may be positioned thereon. The core 31 may include a cylindrical shape comprising a constant radius and the plurality of wires 40 may be wound around an external peripheral surface of the core 31, respectively.

Accordingly, all of the plurality of wires 40 may be wound or rewound by the same length in accordance with the rotation of the core 31 comprising a constant radius, and the lifter 1 may be stably vertically move to the ceiling C while maintaining the balance.

In addition, the core 31 may include the motor rotary shaft insertion opening 31*b* formed at the center of the core 31 along the direction of the rotary shaft A.

The motor rotary shaft insertion opening 31*b* may be formed in a shape corresponding to the motor rotary shaft 24 so that the motor rotary shaft 24 is able to be inserted. Accordingly, the core 31 is not eccentric and the entire core 31 may rotate at the same RPM in accordance with the rotation of the motor rotary shaft 24.

The plurality of winding parts 32 may be disposed on the outer peripheral surface of the core 31 at regular intervals along the direction of the rotary shaft A and the plurality of wires 40 may be wound around and connected to the plurality of winding parts 32, respectively.

Specifically, the plurality of winding parts 32 may include first to fourth winding parts 32*a*, 32*b*, 32*c*, and 32*d*.

Figure 7:
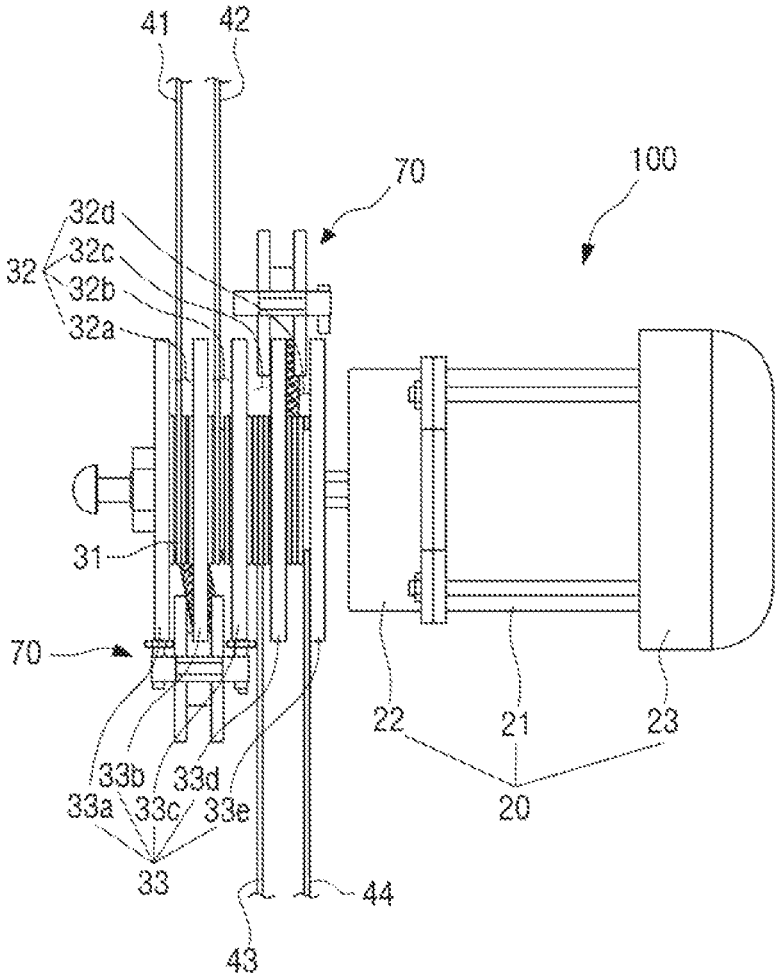
FIG. 7 is a flat view illustrating a state where the driving part is coupled to a plurality of wires.

For example, referring to FIG. 7, the first wire 41 may be wound around the first winding part 32*a*, the second wire 42 may be wound around the second winding part 32*b*, the third wire 43 may be wound around the third winding part 32*c*, and the fourth wire 44 may be wound around the fourth winding part 32*d*, respectively.

Accordingly, even when the first to fourth wires 41, 42, 43, and 44 are wound around the first to fourth winding parts 32*a*, 32*b*, 32*c*, and 32*d* in accordance with the rotation of the drum 30, the first to fourth wires 41, 42, 43, and 44 may be wound around the first to fourth winding parts 32*a*, 32*b*, 32*c*, and 32*d* corresponding thereto one on one, respectively, and accordingly, the first to fourth wires 41, 42, 43, and 44 are not interfered by each other. Therefore, because the first to fourth wires 41, 42, 43, and 44 are not interfered by each other during the winding process, the lifter 1 may stably move while maintaining the balance with respect to the ceiling C.

The plurality of winding parts 32 may be defined as spaces around which the plurality of wires 40 are wound, respectively. In addition, the plurality of winding parts 32 may be formed by the plurality of ribs 33 coupled to the outer peripheral surface of the core 31. Further, the plurality of winding parts 32 may be formed of certain grooves formed on the outer peripheral surface of the core 31.

The plurality of ribs 33 may be formed vertically to the outer peripheral surface of the core 31. In addition, the plurality of ribs 33 may be disposed at regular intervals along the direction of the rotary shaft 33, thereby partitioning the plurality of winding parts 32.

Specifically, the plurality of ribs 33 may include first to fifth ribs 33*a*, 33*b*, 33*c*, 33*d*, and 33*e*. The first to fourth winding parts 32*a*, 32*b*, 32*c*, and 32*d* may be formed between two adjacent ribs among the first to fifth ribs 33*a*, 33*b*, 33*c*, 33*d*, and 33*e*.

For example, referring to FIG. 7, the first winding part 32*a* may be formed between the first and second ribs 33*a* and 33*b*, the second winding part 32*b* may be formed between the second and third ribs 33*b* and 33*c*, the third winding parts 32*c* may be formed between the third and fourth ribs 33*c* and 33*d*, and the fourth winding part 32*d* may be formed between the fourth and fifth ribs 33*d* and 33*e*.

Further, the plurality of ribs 33 may include a radius greater than the core 31 with respect to the rotary shaft A. Accordingly, the plurality of ribs 33 may space apart each of the plurality of wires 40 before the plurality of wires 40 wound around the core 31 are wound or rewound.

For example, referring to FIG. 7, the first wire 41 wound around the first winding part 32*a* and the second wire 42 wound around the second winding part 32*b* may be spaced apart from each other by the second rib 33*b* in the vicinity of the outer peripheral surface of the core 31. In addition, the third wire 43 wound around the third winding part 32*c* and the fourth wire 44 wound around the fourth winding part 32*d* may be spaced apart from each other by the fourth rib 33*d* in the vicinity of the outer peripheral surface of the core 31.

Further, the lifter 1 may include a plurality of pressurization parts 70 which are inserted to the plurality of winding parts 32, respectively, and pressurize the plurality of wires 40 wound around the plurality of winding parts 32 towards the core 31, respectively.

Specifically, the plurality of pressurization parts 70 may be inserted to the plurality of winding parts 32*a*, 32*b*, 32*c*, and 32*d*, respectively, and may pressurize the plurality of wires 41, 42, 43, and 44 wound around the plurality of winding parts 32*a*, 32*b*, 32*c*, and 32*d* towards the core 31, respectively.

In addition, the plurality of pressurization parts 70 may be disposed at both sides of the drum 30 in a direction perpendicular to the rotary shaft A. Further, each of the plurality of pressurization parts 70 may include a pressurization member 71, a fixing member 72, an elastic member 73, and a coupling member 74.

The pressurization member 71 may come into contact with the plurality of wires 40 wound around the core 31 to pressurize the plurality of wires 40 towards the core 31. In addition, the pressurization member 71 may rotate by itself to reduce friction with the plurality of wires 40, because the pressurization member 71 directly comes into contact with the plurality of wires 40 wound in accordance with the rotation of the core 31.

It is enough as long as the pressurization member 71 is rotatable by itself and a separate rotation power unit is not needed. In other words, the pressurization member 71 may rotate in accordance with the contact with the plurality of wires 40 wound in accordance with the rotation of the core 31.

Therefore, the pressurization member 71 may prevent the plurality of wires 40 wound around the plurality of winding parts 32 from getting tangled.

For example, the pressurization member 71 may pressurize the first wire 41 wound around the first winding part 32*a* in the direction of the core 31 so that the first wire 41 is tightly wound around the core 31 without a gap between the first wire 41 and the core 31.

In addition, when the number of pressurization members 71 is more than one, the pressurization member 71 may pressurize the second wire 42 wound around the second winding part 32*b* in the direction of the core 31 so that the second wire 42 is tightly wound around the core 31 without gap between the second wire 42 and the core 31, in addition to the first wires 41 wound around the first winding part 32*a*.

Further, the pressurization member 71 may be a typical pulley. Accordingly, the typical pulleys may be disposed at both sides of the drum 30 to pressurize the plurality of wires 40 in the direction of the core 31, respectively, and the manufacturing cost of the lifter 1 may be reduced due to the use of the typical pulleys.

The fixing members 72 may be coupled to the plurality of pressurization members 71, respectively and may fix the pressurization members 71 so that the pressurization members 71 rotate. The elastic member 73 may be disposed at an end of the fixing member 72 and the coupling members 74 for fixing the fixing member 72 to the lifter 1 may be disposed at the other end of the fixing member 72.

A typical spring with elasticity may be used for the elastic member 73. One end of the elastic member 73 may be connected to the fixing member 72 and another end 73*a* of the elastic member 73 may be connected to a lower extending part 26 formed on a lower side of the drum 30 along the direction of the rotation shaft A from the motor part 20 to be spaced apart from the drum 30 at a certain interval.

Accordingly, the elastic member 73 may pressurize the fixing member 72 in the direction of the core 31 to substantially pressurize the pressurization member 71 connected to the fixing member 72 in the direction of the core 31. In addition, although the amount of one wire 40 wound around one winding part 31 changes in accordance with the vertical movement of the lifter 1, the pressurization part 72 may continuously pressurize the one wire 40 by the elastic member 72 in the direction of the core 31.

The coupling member 74 may fix the pressurization member 71 and the fixing member 72 to one side of the lifter 1. Specifically, the coupling member 74 may be fixed to a side surface 25*a* of the case 25.

The coupling member 74 may be fixed to the side surface 25*a* of the case 25 by various methods such as screwing, bolting, and the like, if necessary.

Figure 5:
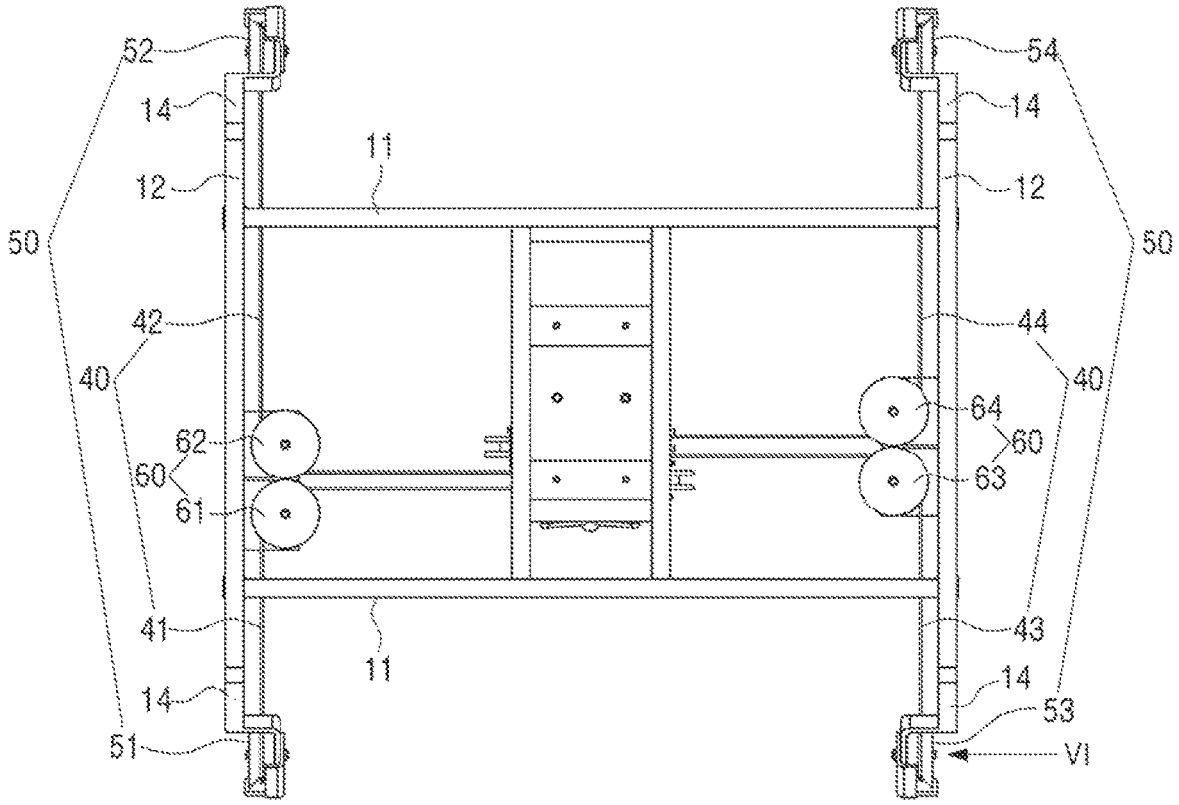
FIG. 5 is a flat view of the lifter illustrated in FIG. 1.
Figure 6:
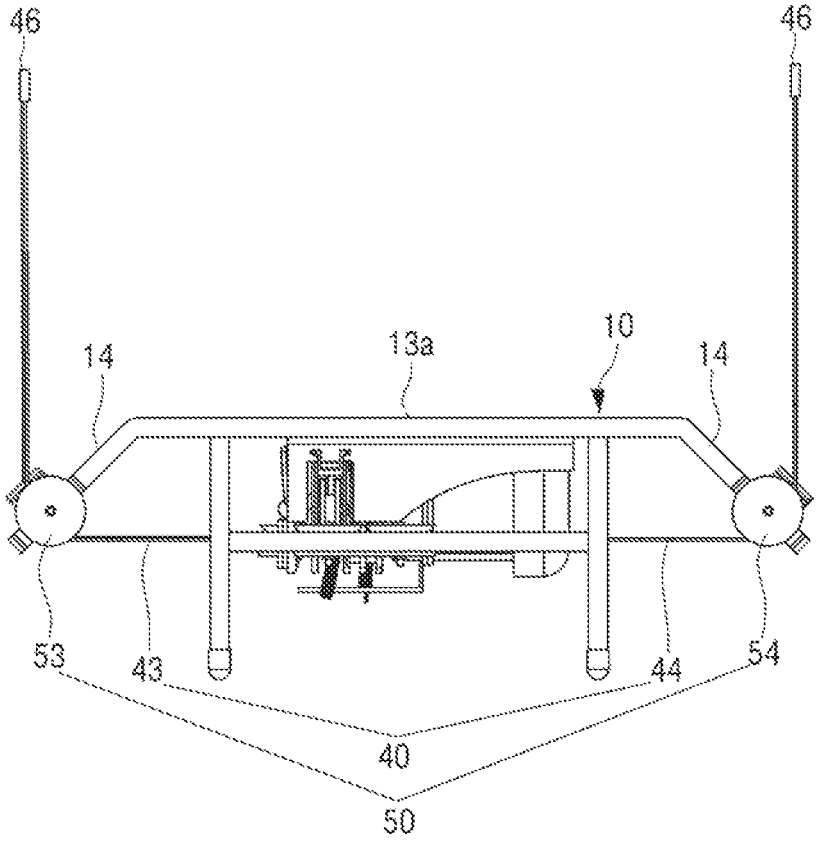
FIG. 6 is a side view illustrating the lifter in a VI direction of FIG. 5.

FIG. 5 is a flat view of the lifter 1 illustrated in FIG. 1, FIG. 6 is a side view illustrating the lifter 1 in a VI direction of FIG. 5, and FIG. 7 is a flat view illustrating a state where the driving part 100 is coupled to the plurality of wires 40.

Hereinafter, the specific structure and arrangement of the plurality of vertical pulleys 50 and the plurality of horizontal pulleys 60 will be described with reference to FIGS. 5 to 7.

Referring to FIGS. 5 to 7, the plurality of vertical pulleys 50 may include first to fourth vertical pulleys 51, 52, 53, and 54 disposed radially from the center of the frame 10 and the first to fourth wires 41, 42, 43, and 44 may be wound around the first to fourth vertical pulleys 51, 52, 53, and 54, respectively.

Specifically, the first wire 41 may be wound around the first vertical pulley 51, the second wire 42 may be wound around the second vertical pulley 52, the third wire 43 may be wound around the third vertical pulley 53, and the fourth wire 44 may be wound around the fourth vertical pulley 54.

The first to fourth vertical pulleys 51, 52, 53, and 54 are disposed radially from the center of the frame 10, thus, the first to fourth wires 41, 42, 43, and 44 wound around the first to fourth vertical pulleys 51, 52, 53, and 54 may be horizontally diffused to change the direction of the first to fourth wires 41, 42, 43, and 44 to the direction perpendicular to the ceiling C.

In addition, referring to FIG. 6, the first to fourth vertical pulleys 51, 52, 53, and 54 may be horizontally disposed on the same plane.

Accordingly, all the first to fourth vertical pulleys 51, 52, 53, and 54 may be spaced apart from the ceiling C by the same distance during the vertical movement of the lifter 1. Therefore, when the driving part 100 winds the first to fourth wires 41, 42, 43, and 44, the lifter 1 may vertically move with respect to the ceiling C while stably maintaining balance.

Further, the plurality of horizontal pulleys 60 may include first to fourth pulleys 61, 62, 63, and 64 facing the outer peripheral surface of the drum 30 and the first to fourth wires 41, 42, 43, and 44 may be wound around the first to fourth horizontal pulleys 61, 62, 63, and 64, respectively.

In addition, the first to fourth horizontal pulleys 61, 62, 63, and 64 may be disposed between the one ends of the plurality of wires 40 and the first to fourth vertical pulleys 51, 52, 53, and 54 and the first to fourth wires 41, 42, 43, and 44 may be wound around the first to fourth horizontal pulleys 61, 62, 63, and 64.

Accordingly, the one end of the first wire 41 may be connected to the drum 30 of the driving part 100 and the other end thereof may be detachably connected to the ceiling C. The first horizontal pulley 61 and the first vertical pulley 51 may be disposed sequentially on the first wire 41 from one end of the first wire 41.

In the same manner, the second horizontal pulley 62 and the second vertical pulley 52 may be disposed sequentially on the second wire 42 from one end of the second wire 42, the third horizontal pulley 63 and the third vertical pulley 53 may be disposed sequentially on the third wire 43 from one end of the third wire 43, and the fourth horizontal pulley 64 and the fourth vertical pulley 54 may be disposed sequentially on the fourth wire 44 from one end of the fourth wire 44.

Further, the first and second horizontal pulleys 61 and 62 may be positioned at one side of the drum 30 and the third and fourth horizontal pulleys 63 and 64 may be positioned at the opposite side of the first and second horizontal pulleys 61 and 62 with respect to the drum 30.

Accordingly, referring to FIG. 2, the first and second wires 41 and 42 may be wound around the drum 30 via an upper contact point of the drum 30 and the third and fourth wires 43 and 44 may be wound around the drum 30 via a lower contact point of the drum 30.

Therefore, when the drum 30 rotates clockwise R, the first to fourth wires 41, 42, 43, and 44 may be wound around the drum 30 at the same time.

Further, the first and second horizontal pulleys 61 and 62 may be disposed in a row at one side of the frame 10 facing the outer peripheral surface of the drum 30 to be parallel with the rotary shaft A. Accordingly, the first and second wires 41 and 42 may be wound around the first and second horizontal pulleys 61 and 62 respectively in a direction in which the first and second horizontal pulleys 61 and 62 face each other, thereby changing the direction of the first and second wires 41 and 42 to the direction towards the first and second vertical pulleys 51 and 52.

In the same manner, the third and fourth horizontal pulleys 63 and 64 may be disposed in a row at the other side of the frame 10 that is opposite to the side where the first and second horizontal pulleys 61 and 62 are disposed with respect to the drum 30 to be parallel with the rotary shaft A. Accordingly, the third and fourth wires 43 and 44 may be wound around the third and fourth horizontal pulleys 63 and 64 respectively in a direction in which the third and fourth horizontal pulleys 63 and 64 face each other, thereby changing the direction of the third and fourth wires 43 and 44 to the direction towards the third and fourth vertical pulleys 53 and 54.

In other words, the first and second wires 41 and 42 may be diffused on the same plane from the first and second horizontal pulleys 61 and 62 and the third and fourth wires 43 and 44 may be diffused on the same plane from the third and fourth horizontal pulleys 63 and 64. Therefore, the balance of the lifter 1 may be more stably maintained by the first to fourth wires 41, 42, 43, and 44 connected to the frame 10 of the lifter 1 in a diffused manner.

Referring to FIG. 5, the first and second horizontal pulleys 61 and 62 may be disposed at a position perpendicular to the plane between the driving part 100 and the first and second vertical pulleys 51 and 52, respectively, to change the direction of the first and second wires 41 and 42 to be perpendicular to the plane via the first and second horizontal pulleys 61 and 62.

In the same manner, the third and fourth horizontal pulleys 63 and 64 may be disposed at a position perpendicular to the plane between the driving part 100 and the third and fourth vertical pulleys 53 and 54, respectively, to change the direction of the third and fourth wires 43 and 44 to be perpendicular to the plane via the third and fourth horizontal pulleys 63 and 64.

Therefore, the first to fourth horizontal pulleys 61, 62, 63, and 64 may be disposed to be symmetrical with respect to the drum 30 in the frame 10, thereby stably maintaining the balance of the lifter 1 disposed in the air from the ceiling C using the plurality of wires 40.

Figure 8:
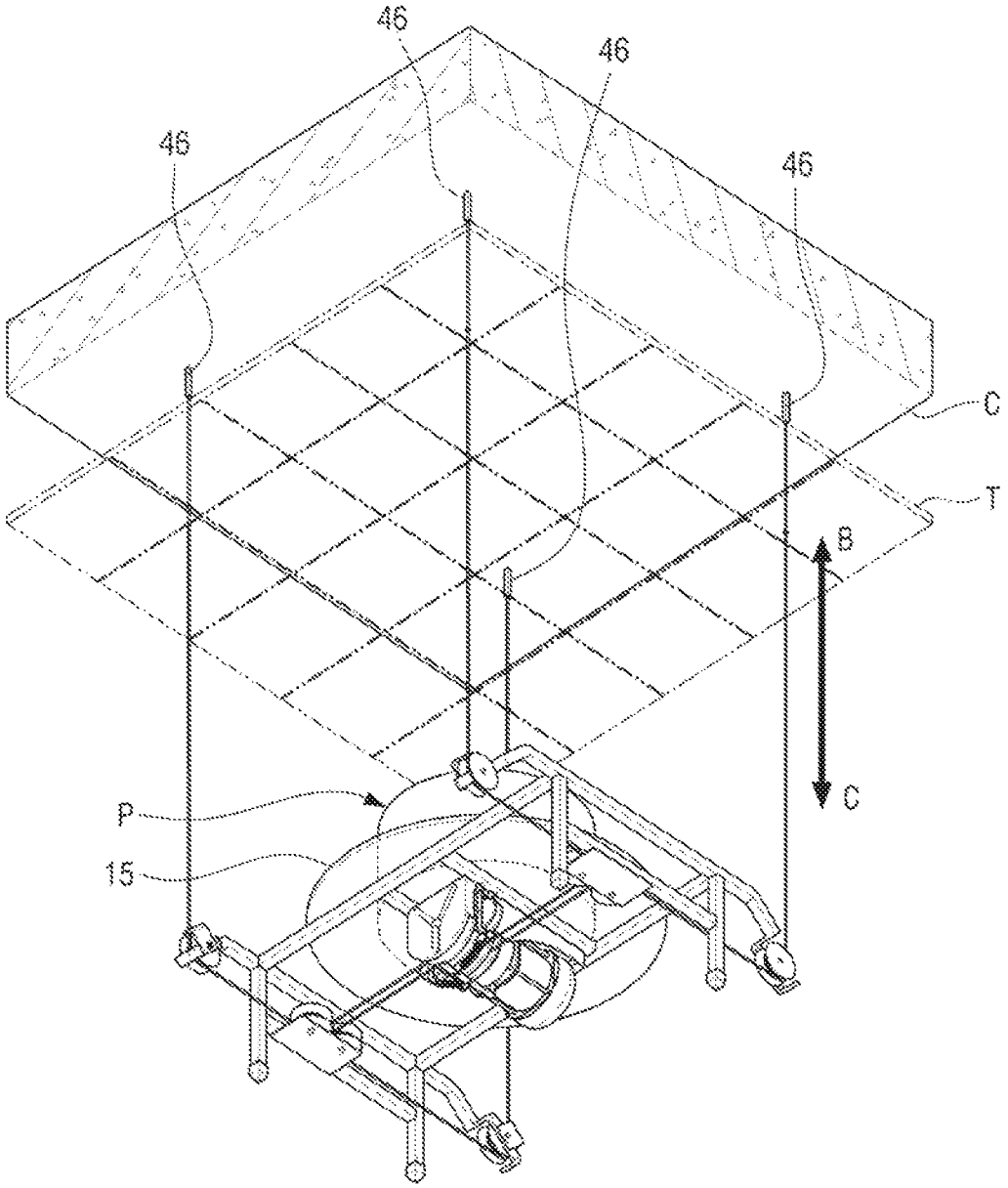
FIGS. 8 and 9 are perspective views illustrating operations of the lifter according to an embodiment.
Figure 9:
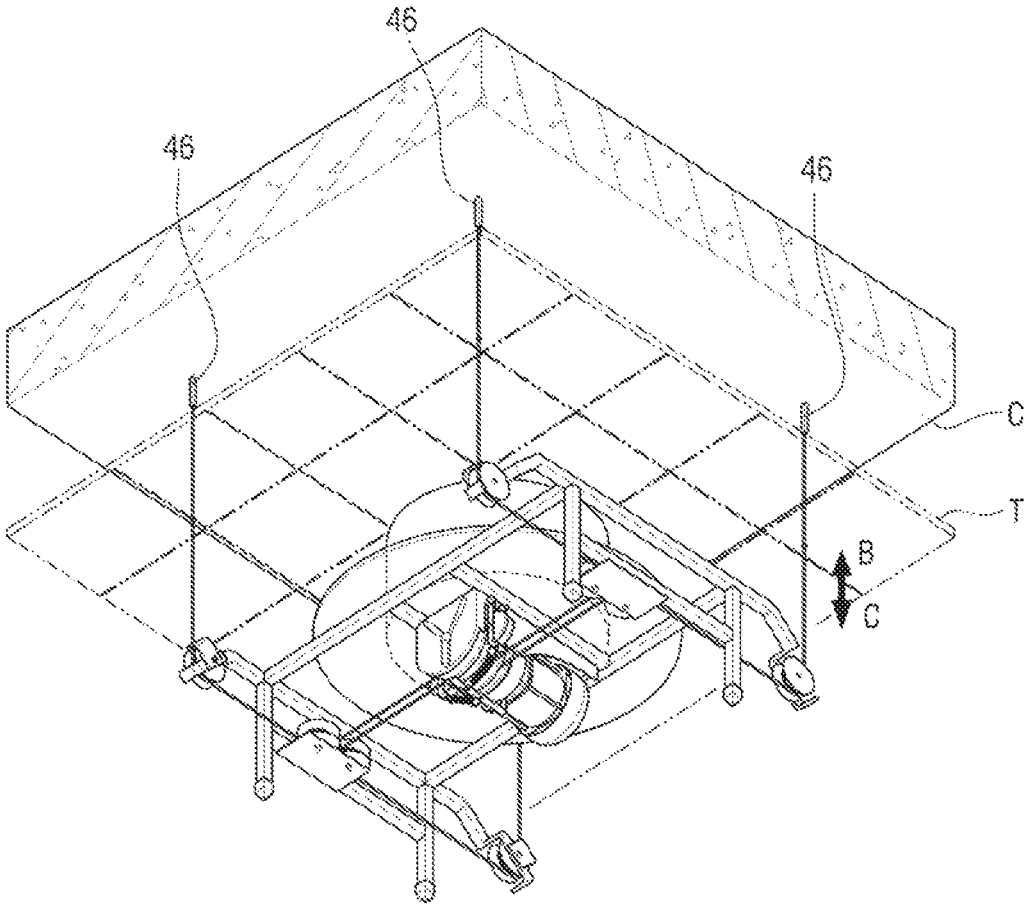

FIGS. 8 and 9 are perspective views illustrating operations of the lifter 1 according to an embodiment.

Hereinafter, the operations of the lifter 1 will be described in detail with reference to FIGS. 8 and 9.

Referring to FIGS. 8 and 9, a ceiling of a typical building may be formed of the ceiling C formed of a concrete material and a texture T disposed on a lower portion of the ceiling C to be spaced apart at a certain interval. Accordingly, in a case of installing the product P, particularly, a ceiling air conditioner onto the portion of the texture T, firstly, the connection members 46 connected to the other ends 40*b* of the plurality of wires 40 may be fixed to the ceiling C.

Then, the product P to be installed may be disposed on the loading part 15 disposed on the front surface 13*a* of the frame 10.

Next, the motor 21 of the driving part 100 may be operated to rotate the drum 30. At this time, the plurality of wires 40 may be wound around the drum 30 by the drum 30 rotating in a certain direction in a state where the direction of the plurality of wires 40 is changed to the direction perpendicular to the ceiling C by the plurality of horizontal pulleys 60 and the plurality of vertical pulleys 50, respectively.

Specifically, the first wire 41 may be wound around the first winding part 32*a* in accordance with the rotation of the drum 30, and the lifter 1 may move in a direction towards the ceiling C (B direction) by the length of the first wire 41 wound around the first winding part 32*a*. Therefore, the lifter 1, on which the product P is disposed, may move (up) to be close to the texture T upward direction (B direction) to the ceiling C.

At this time, as described above, the plurality of wires 40 may be wound around the plurality of winding parts 32 respectively to be spaced apart at regular intervals, the plurality of wires 40 may be wound around the plurality of winding parts 32 respectively without mutual interference and friction, and accordingly, the lifter 1 may stably move to the ceiling C in the upward direction B while maintaining the balance.

The product P may be installed onto the ceiling C by the worker in a state where the lifter 1 has stably moved up.

When the installation of the product P onto the ceiling C is completed, the motor 21 of the driving part 100 may be operated to rotate the drum 30 in the opposite direction again to rewind the plurality of wires 40 so that the lifter 1 may move in a downward direction (C direction).

Specifically, the first wire 41 is rewound from the first winding part 32*a* in accordance with the rotation of the drum 30 and the lifter 1 may move in a direction (C direction) farther away from the ceiling C by the length of the first wire 41 rewound from the first winding part 32*a*. Then, the lifter 1 may be separated from the ceiling C by separating the connection member 46 connected to the ceiling C from the ceiling C.

Hereinabove, various embodiments of the disclosure have been individually described, but each embodiment is not necessarily implemented alone and the configuration and the operation of each embodiment may be implemented to be combined with at least another embodiment.

While certain embodiments have been particularly shown and described with reference to the drawings, the embodiments are provided for the purposes of illustration and it will be understood by one of ordinary skill in the art that various modifications and equivalent other embodiments may be made from the disclosure. Accordingly, the true technical scope of the disclosure is defined by the technical spirit of the appended claims.

What is claimed is:

1. A lifter that is detachably disposed on a ceiling, the lifter comprising:

a frame that includes a loading part on which a product is placed, the frame formed to be transportable;

a motor part coupled to the frame;

a drum rotatably coupled to the motor part and including a plurality of winding parts formed at regular intervals along a rotary shaft direction;

a plurality of wires connected to be wound around the plurality of winding parts, respectively, and a plurality of connection members formed to be detachably fixable to the ceiling;

wherein one end of each of the plurality of wires is connected to a respective one of the plurality of winding parts, and another end of each of the plurality of wires is detachably fixable to each of the plurality of connection members, wherein the motor part and the drum are disposed below a center of the frame under the loading part, wherein when the frame is positioned on a floor, the plurality of connection members are detachably fixed to the ceiling, wherein when the drum rotates in one direction, the plurality of wires are wound on the plurality of winding parts of the drum so that the frame, in which the motor part and the drum are disposed, moves up to be close to the ceiling, and when the drum rotates in a direction opposite to the one direction, the plurality of wires are unwound from the plurality of winding parts of the drum so that the frame moves down and positioned on the floor.

2. The lifter according to claim 1, wherein the drum comprises:

a core; and a plurality of ribs formed vertically on an outer peripheral surface of the core and disposed at regular intervals along the rotary shaft direction to partition the plurality of winding parts.

3. The lifter according to claim 2, wherein the frame comprises a plurality of vertical pulleys disposed radially from the center of the frame, and wherein the plurality of vertical pulleys are disposed between the one ends and the other ends of the plurality of wires respectively to change a direction of the plurality of wires to a direction perpendicular to the ceiling.

4. The lifter according to claim 3, wherein the plurality of winding parts comprises first to fourth winding parts, and wherein the plurality of wires comprises first to fourth wires wound around the first to fourth winding parts, respectively.

5. The lifter according to claim 4, wherein the plurality of ribs comprises first to fifth ribs, and wherein each of the first to fourth winding parts is formed between two adjacent ribs among the first to fifth ribs.

6. The lifter according to claim 5, wherein the plurality of vertical pulleys comprise first to fourth vertical pulleys disposed radially from the center of the frame, and wherein the first to fourth wires are wound around the first to fourth vertical pulleys, respectively.

7. The lifter according to claim 6, wherein the first to fourth vertical pulleys are disposed horizontally on the same plane.

8. The lifter according to claim 6, further comprising:

a plurality of horizontal pulleys disposed between the one ends of the plurality of wires and the plurality of vertical pulleys, respectively.

9. The lifter according to claim 8, wherein the plurality of horizontal pulleys comprise first to fourth horizontal pulleys facing the outer peripheral surface of the drum, and wherein the first to fourth horizontal pulleys are disposed between the one ends of the plurality of wires and the first to fourth vertical pulleys, respectively, and the first to fourth wires are wound around the first to fourth horizontal pulleys, respectively.

10. The lifter according to claim 9, wherein the first and second horizontal pulleys are positioned at one side of the drum, and wherein the third and fourth horizontal pulleys are positioned at a side opposite to the first and second horizontal pulleys with respect to the drum.

11. The lifter according to claim 10, wherein each rotary shaft of the first to fourth vertical pulleys is disposed to be parallel with the ceiling, and wherein each rotary shaft of the first to fourth horizontal pulleys is disposed to be perpendicular to the rotation shaft of the first to fourth vertical pulleys.

12. The lifter according to claim 2, further comprising:

a plurality of pressurization parts configured to be inserted to the plurality of winding parts, respectively, and pressurize the plurality of wires wound around the plurality of winding parts towards the core, respectively.

13. The lifter according to claim 12, wherein each of the plurality of pressurization parts comprises:

a pressurization member coming into contact with each of the plurality of wires; and a fixing member coupled to the pressurization members to enable the pressurization member to rotate.

14. The lifter according to claim 13, wherein an elastic member is disposed at one end of the fixing member, and wherein the elastic member is connected to a lower extending part extending to be parallel with a shaft direction of the drum at a certain interval from the drum.

15. The lifter according to claim 3, wherein the frame further comprises:

a square main body part facing the ceiling; and an extending part formed at each corner of the main body part, wherein the plurality of vertical pulleys are disposed on each extending part.

* * * * *